US011549770B2

(12) United States Patent
Bellitti et al.

(10) Patent No.: US 11,549,770 B2
(45) Date of Patent: Jan. 10, 2023

(54) MODULAR FIREARM ADAPTER SYSTEM AND DEVICE

(71) Applicant: Amend2, LLC, Idaho, ID (US)

(72) Inventors: Matt Bellitti, Ammon, ID (US); Austin Damoth, Ammon, ID (US); Mark Hillis, Ammon, ID (US); Erik Partridge, Ammon, ID (US)

(73) Assignee: Amend2, LLC, Idaho City, ID (US)

( * ) Notice: Subject to any disclaimer, the term of this patent is extended or adjusted under 35 U.S.C. 154(b) by 93 days.

(21) Appl. No.: 17/129,690

(22) Filed: Dec. 21, 2020

(65) Prior Publication Data

US 2021/0190448 A1 Jun. 24, 2021

Related U.S. Application Data

(60) Provisional application No. 62/950,633, filed on Dec. 19, 2019.

(51) Int. Cl.
*F41A 9/71* (2006.01)
*F41A 11/02* (2006.01)

(52) U.S. Cl.
CPC ..... *F41A 9/71* (2013.01); *F41A 11/02* (2013.01)

(58) Field of Classification Search
CPC .... F41A 9/71; F41A 11/02; F41A 3/66; F41C 23/10
See application file for complete search history.

(56) References Cited

U.S. PATENT DOCUMENTS

| | | | | | |
|---|---|---|---|---|---|
| 5,555,661 | A * | 9/1996 | Yap | F41A 9/71 | 42/49.02 |
| 5,566,488 | A * | 10/1996 | Yap | F41A 9/71 | 42/49.02 |
| 6,070,352 | A * | 6/2000 | Daigle | F41A 11/02 | 42/49.02 |
| 7,934,443 | B1 * | 5/2011 | Bennett | F41A 9/79 | 89/33.14 |
| 8,429,844 | B2 * | 4/2013 | Dextraze | F41A 3/18 | 42/73 |
| 10,006,730 | B1 * | 6/2018 | Pikielny | F41A 9/65 | |
| 10,119,777 | B2 * | 11/2018 | Wolf | F41A 19/15 | |
| 10,254,059 | B1 * | 4/2019 | Fellows | F41A 3/66 | |
| 10,429,143 | B2 * | 10/2019 | Zajk | F41A 17/56 | |
| 11,187,492 | B2 * | 11/2021 | Mumford | F41C 23/10 | |
| 2009/0071053 | A1 * | 3/2009 | Thomele | F41A 11/02 | 42/70.08 |

* cited by examiner

*Primary Examiner* — Joshua T Semick
(74) *Attorney, Agent, or Firm* — Loyal IP Law, PLLC; Travis Banta

(57) ABSTRACT

The present disclosure relates to a modular firearm frame adapter that aid in making compatible a slide associated with a first firearm and a frame associated with a second firearm. The compatibility is such that the slide associated with a first firearm and a magazine associated with a second firearm being able to function properly as a single integrated firearm. This system includes an adapter, and one or more adapter elements that aids allowing the modular firearm to function properly.

18 Claims, 4 Drawing Sheets

MODULAR FIREARM ADAPTER SYSTEM AND DEVICE

CROSS-REFERENCE TO RELATED APPLICATIONS

This application claims the benefit of U.S. Provisional Application No. 62/950,633, filed Dec. 19, 2019, which is incorporated herein by reference in its entirety, including but not limited to those portions that specifically appear hereinafter, the incorporation by reference being made with the following exception: In the event that any portion of the above-referenced provisional application is inconsistent with this application, this application supersedes said above-referenced provisional application.

BACKGROUND

The first firearms use began in the 14$^{th}$ century and were essentially miniature cannons small enough to be held by a man. These firearms required a match, spark, or ember to light a flash pan that held primer powder to be able to fire these primitive firearms. In time, a matchlock mechanism was developed which lowered a match to the flash pan of the firearm when a trigger was pulled. This allowed the user to hold and aim the gun while waiting for it to fire. Even though the matchlock mechanism allowed the user to aim the firearm, an external fire source to light the matchlock was still necessary to ignite gunpowder when the trigger was pulled. The flintlock mechanism improved upon the matchlock because the flintlock mechanism created a spark, on demand, when the trigger was pulled to ignite the primer powder in the flash pan. The problem with the flintlock mechanism is that the mechanism often misfired in inclement weather and failed to ignite wet powder making the reliability of firearms with a flintlock mechanism questionable. This prompted the creation of a percussion cap. Percussion caps contained a dry mixture of chemicals which were explosively sensitive to shock (e.g., from a falling hammer on a firearm) and allowed a user to fire reliable regardless of the weather. Percussion caps, containing a shock-sensitive explosive, ignited upon the impact of a hammer that was released when the trigger was pulled which allowed fire created by the explosion to ignite gunpowder within the firearm and fire a bullet.

As firearms improved so did the ammunition used with the firearms. Ammunition like that used in a cannon was round (e.g., a ball) and advanced from stone to iron and later to lead. Cannon balls were installed in a barrel and rammed into a seated position on top of gunpowder in the cannon, or on a wad between the gunpowder and the cannon ball. These cannon balls were wildly inaccurate because of an unpredictable spin that occurred when the cannon balls were fired. Firearms of the era were also "smoothbore" (e.g., lacking grooves) which caused unpredictable spin on a lead ball or cannon ball. To improve accuracy, helical rifle grooves were machined into the inside of barrels in both cannons and firearms. Machining these grooves was called rifling and was not initially very popular because rifling made cleaning barrels a substantially more difficult task. Refinements in gunpowder technology and the development of ammunition cartridges increased the popularity of rifled barrels because shooters benefited from the accuracy improvements while also reducing the work associated with cleaning a firearm barrel.

The development of an ammunition cartridge, which contained all the components necessary to fire a projectile from a firearm in one object, revolutionized firearms technology. Ammunition cartridges include a metallic case, preferably brass, fitted to accept a primer, gunpowder, and a projectile. More commonly, an ammunition cartridge is referred to as a "bullet" even though the projectile, the bullet, is but one element of an ammunition cartridge. One of the reasons for this clarification is that ammunition cartridges are made in different sizes. The sizes are often labeled by the diameter of the bullet also referred to as a caliber. Caliber was originally used to define the diameter of a barrel bore and now it is often used to describe bullets corresponding to the bore diameter. For example, a brass case may be a particular size, provide a primer pocket for receiving a primer of a particular size, have an internal volume of a specific size to receive gun powder, and may further accept a bullet of a particular caliber typically measured in tenths or thousandths of an inch in the United States and using metric diameter measurements in countries that use metric measurements.

The development of ammunition cartridges further improved the moving of ammunition into a chamber of a firearm and the speed of firing. Two devices were created to hold ammunition in a usable position within a firearm, a clip and a magazine. A clip groups ammunition cartridges together, but has no moving parts. Firearms that use clips contain mechanisms to move the ammunition cartridge from the clip and inserts the round into a firing position in the chamber. The magazine, often mistakenly identified as a clip, aids in not only storing rounds but also moving the round into firing position by use of spring tension, pushing magazines towards a top of the magazines. The dimensions of magazines depend on many ammunition cartridge and firearm characteristics, including the caliber of bullet, the length of the firearm frame, the angle of magazine port, the number of ammunition rounds, the firearm retrieval site, the type of bolt, the size and shape of the slide, the size and shape of the magazine port, the weight preferences etc. The dimensional specifications of magazines makes modularity extremely difficult in that a magazine designed for a particular firearm will only operate within that particular firearm model. Any seemingly minor change in the dimensions of a magazine or a of a slide from one model to another renders such magazine useless to any other firearm model even if it contains ammunition of the same caliber.

To accommodate for different dimensional specifications for magazines, firearms manufacturers have created different models of firearms that are designed for shooters with different grip preferences or hand sizes. For example, a user may prefer a wider grip, while another likes a longer grip, another may wish to conceal a and desire a smaller grip profile while others may desire a magazine that holds a desired number of ammunition cartridges. All of these alterations change the dimension of the firearm magazine and in so doing changes the mechanisms for receiving the cartridges stored in the magazine.

To further explain using an automatic pistol, a pistol can be grouped into two major parts an upper portion referred to herein as an upper or slide portion and a lower or frame portion. In some embodiments, the slide portion may include a slide, barrel, guide rod, recoil spring, firing pin, ammunition receiving port, receiver rail, and ammunition ejector port to name a few. In some embodiments, the frame portion may include trigger group, grip, magazine receiver port, magazine, magazine ejector button, ejector button, connector rail, disassembly pin and lever, and etc. Both the slide portion and frame portions are interconnected and interrelated. A receiver rail in the frame and a connector rail in the slide must both be aligned or a slider portion cannot connect with a frame portion. If a slide removal pin is not aligned correctly, the pistol could not be taken apart (field stripped) to allow for a more thorough cleaning. A trigger assembly in the frame portion does not work if it does not interact with the firing pin in the slide portion. Finally, the ammunition feed port where a magazine offloads a bullet into a receiving chamber of the firearm cannot function properly if not aligned correctly. In other words, if a magazine is not precisely positioned within a firearm, the firearm will not successfully load an ammunition cartridge to be fired. Further, magazines with dimensional specifications that include even very minor differences cannot be used in a firearm for which the magazine is not intended because ammunition cartridges will not properly exit the ammunition feed port in the magazine into the chamber of the firearm due to misalignment of the magazine and the firearm. Any of these misalignments may not only keep the pistol from firing properly but may also cause misfires or cause ammunition cartridges to detonate at an improper location putting both the user and any bystanders in mortal danger.

It is, therefore, one object of this disclosure to describe an example of a modular portion of a firearm to receive a magazine associated with the lower portion of a firearm and combine it with an upper portion of a firearm that is not normally compatible with the lower portion while providing satisfactory operation of the firearm. It is another object of this disclosure to provide a grip module which provides an adapter that allows a magazine that is not intended for a use with a particular slide portion to be properly installed and fitted to the particular slide portion while providing satisfactory operation of the firearm.

SUMMARY OF THE DISCLOSURE

Disclosed herein is a modular firearm frame device that includes a receiver rail which mechanically interacts with a firearm slide mechanically sized to operate on a first firearm model. The modular fire frame also includes a magazine port which mechanically accepts a magazine mechanically sized to receive a magazine from a second firearm model, different from the first firearm model. Disposed within the magazine port is an adapter which aligns the magazine within the magazine port such that the magazine holds an ammunition cartridge in a position within the modular firearm frame device where operation of the slide on the modular firearm frame device causes the ammunition cartridge to be loaded into a chamber of a firearm associated with the modular firearm frame device.

Also disclosed is a modular firearm frame device comprising a receiver rail and a magazine port. The receiver rail is mechanically sized to accept a slide from a first handgun. The magazine port is sized to operably receive a magazine that is inoperable in the first handgun. Furthermore, an adapter is disposed within the magazine port which aligns the magazine within the magazine port such that the magazine holds an ammunition cartridge in a position within the modular firearm frame device where operation of the slide on the modular firearm frame device causes the ammunition cartridge to be loaded into a chamber of a firearm associated with the modular firearm frame device.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure provides novel modular firearm frames which may be used with various types of firearms including semi-automatic pistols, modern sporting rifles, automatic rifles, semi-automatic rifles and other firearms.

In the following description of the disclosure, reference is made to the accompanying drawings, which form a part hereof, and in which is shown by way of illustration specific implementations in which the disclosure is may be practiced. It is understood that other implementations may be utilized and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Described below is a firearm grip module that includes an adapter which itself includes adapter elements, and adapter sub-elements, as are shown in the figures. The adapter shown is not intended to be exclusive but, rather, illustrate examples of a modular firearm adapter that may allow interaction between a slide of a first type or model of firearm and a frame of a second type of firearms that without adaptive alterations are not functionally complimentary. These changes may include size, angle, ramps and contours of a magazine receiving port, apertures for receiving an ejector pin and a disassemble pin, and or notches for a slide catch, a rear cover plate and a magazine seat etc. Adaptive alterations allow a user to take advantage of the benefits of a slide of a first firearm along with the benefits of a frame of a second firearm.

Figure 1:
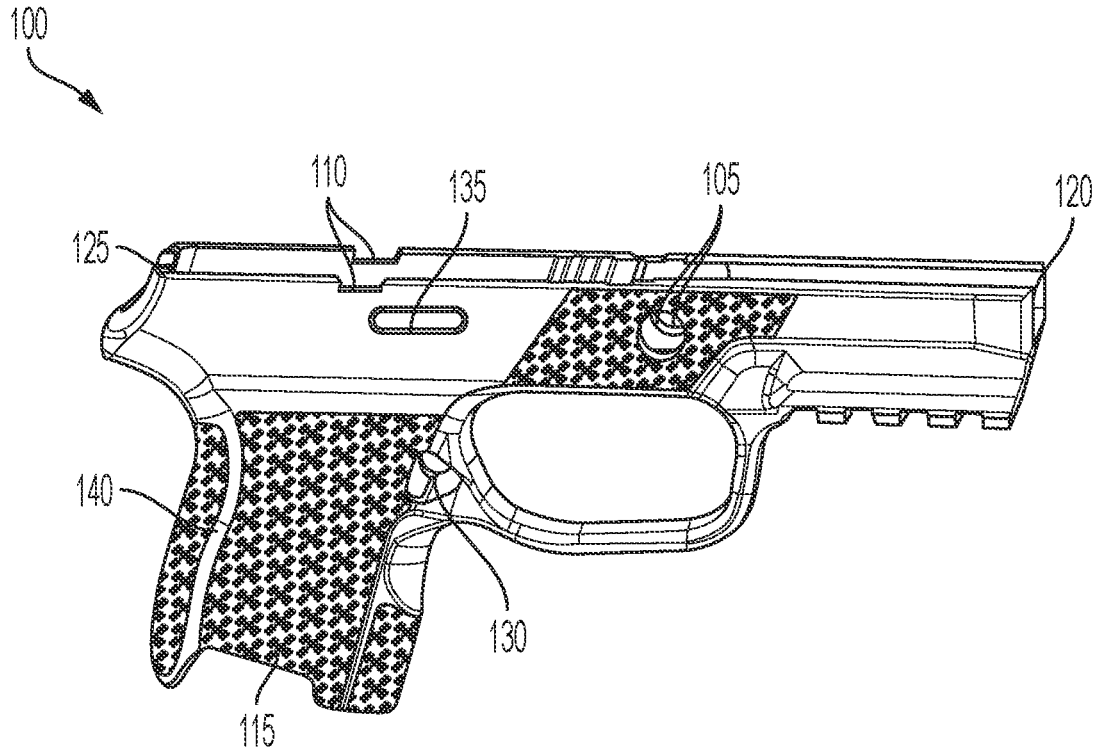
FIG. 1 illustrates a right-sided view of an embodiment of a modular firearm adapter.

FIG. 1 illustrates a right-side view of a modular firearm adapter 100. Modular firearm adapter 100 includes a pin aperture 105 that may house a disassembly pin and lever. Slide catch notches 110 may be located on the right and/or left side of the modular firearm adapter 100 above magazine receiving port 140 and in between rear cover plate notch 125 at the proximal end and rod guide 120. Rear cover plate notch 125 is located at the proximal end of modular firearm adapter 100 and may receive a rear cover plate or may be located near where the rear cover plate is received. Rod guide 120 is located at the distal end of the pistol and is generally semi-circularly shaped to receive a guide rode and or a recoil spring. Modular firearm adapter may optionally include serial number view port 135 for firearms that so locate a serial number which may be located in between rear cover plate notch 125 and rod guide 120. View port 135 may also be located distally to pin aperture 105 or located in other locations in various ways, including engraving, imprinting, or installing of the serial number in any manner that satisfies the requirements for the marking of serial numbers on firearms as required by the United States Division of Alcohol, Tobacco, and Firearms.

Magazine receiving port 140 is located at the proximal end of modular firearm adapter 100 and is sized to accommodate the insertion of an ammunition magazine. Ammunition magazines have many different sizes and shapes to accommodate size and shape of the of the firearm and ammunition cartridges. Disposed within magazine receiving port 140 may be adapters (not seen because of perspective but shown in FIGS. 3-4 and 7-8) on one or more sides of magazine receiving port 140, which will be discussed below. These adapters facilitate the delivery of the ammunition from a magazine to the chamber of the firearm. The base of ammunition magazines may be sized to fit into magazine receiving port 140 and include a catch to be secured within a magazine seat notch 115 that may receive the seat of a magazine. Seat notch 115 may include notches on one, or both of the right and the left side of magazine receiving port 140. Seat notch 115 may be one continuous notch that extends around a portion of the bottom end of magazine receiving port 140. Magazine ejector aperture 130 may be located distally to magazine receiving port 140 and proximally to the trigger guard. Other apertures and notches may be placed in between rear cover plate notch 125 and rod guide 120 to aid in the modularity and the functioning of the firearm.

Modular firearm adapter 100 may implement adapters, adapter elements, and adapter sub elements within magazine receiving port 140 to center a magazine that is intended for a first model of firearm while connecting to a slide portion from a second model of firearm. In one example, a first firearm may be a standard sized model while a second firearm may be a compact sized model. Even though the first firearm and the second firearm shoot the same ammunition cartridge, a magazine from the first firearm and the second firearm are not interchangeable due to the relative sizes of the firearms. Modular firearm adapter 100 replaces a frame of the first firearm to allow use of a standard sized slide with a magazine from the second firearm which is smaller and more suitable for concealed carry applications. In this manner, a user may purchase the first firearm in a standard size, install modular firearm adapter 100, and have a functional concealed carry sized firearm, securing a smaller concealed carry sized magazine for the second firearm without the need to buy the entire second firearm. Essentially, modular firearm adapter 100 allows a user to assemble a concealable smaller firearm that uses a smaller magazine from a standard sized firearm. An adapter included in magazine port 140 compensates for magazine size differences between the magazine for the first firearm and the magazine for the second firearm to allow the magazine for the second firearm to fit and operate with slide portion of the first firearm.

Figure 2:
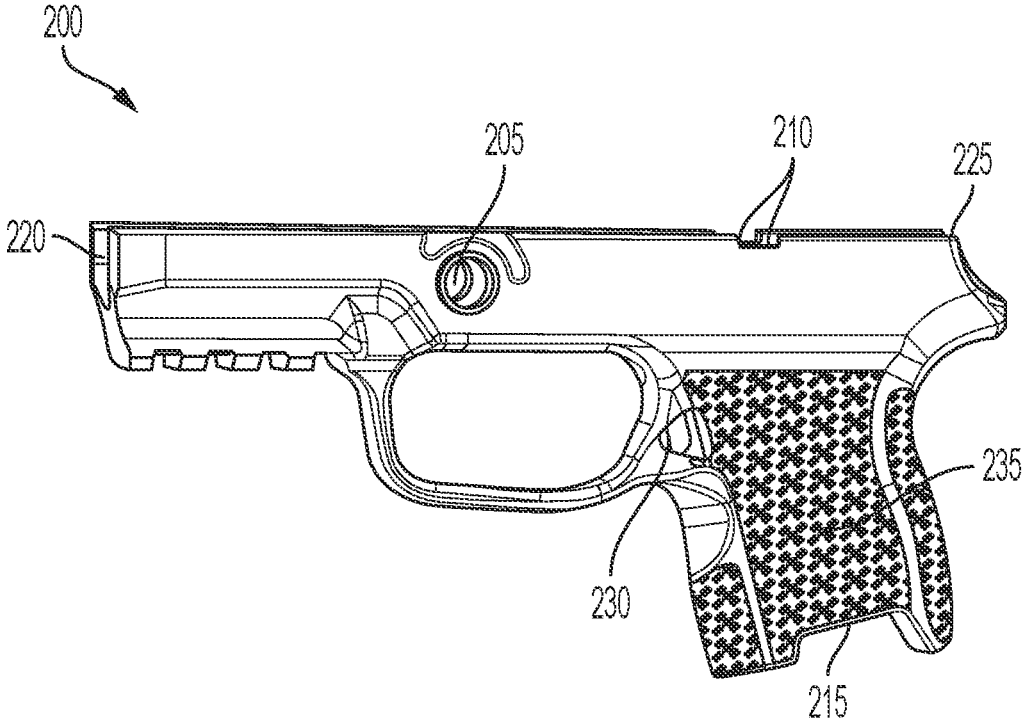
FIG. 2 illustrates a left-sided view of an embodiment of a modular firearm adapter.

FIG. 2 illustrates a left-sided view of a modular firearm adapter 200. Modular firearm adapter 200 includes elements such as pin aperture 205 that may house a disassembly pin and lever. Pin aperture 205 is a connection point which allows the pin and lever to connect with a handgun slide via a fire control group that allows the handgun slide to operably function on a handgun, for example, and secure the slide and fire control group in place on modular firearm adapter 200 (e.g., a pin may be inserted through pin aperture 205 to secure a fire control group or similar element in the modular firearm adapter 200, the fire control group or similar element providing a mechanical attachment between the modular firearm adapter 200 and a firearm slide). Slide catch notches 210 may be located on the right and or left side of the firearm adapter 200 above magazine receiving port 235 and between rear cover plate notch 225 and rod guide 220. Rear cover plate notch 225 is located at the proximal end of firearm adapter 200 and may receive a rear cover plate or may just be located near where the rear cover plate is received. Rod guide 220 is located at the distal end of the pistol and is generally half pipe shaped to receive the guide rod and or the recoil spring of a firearm. Below receiving port 235 is magazine seat notch 215 that may accommodate the seat of a magazine. The seat of a magazine is generally larger than the rest of the magazine and may include a catch to retain the magazine within receiving port 235 and also may require a notch to allow the magazine to fit within receiving port 235. In one embodiment, a magazine may include an element of a grip sized and oriented to position one or more fingers around a grip and the magazine when installed. The magazine may, in this embodiment, continue the grip of modular firearm adapter 300 as it seats within seat notch 215. Seat notch 215 may include notches on one or both the right and the left side. Alternatively, the notch may be one continuous notch that extends around a portion of the bottom end of magazine receiving port 235. Magazine ejector button aperture 230 may be located distally to magazine receiving port 235 and proximally to trigger guard. Other apertures and notches may be placed in between rear cover plate notch and rod guide 220.

Figure 3:
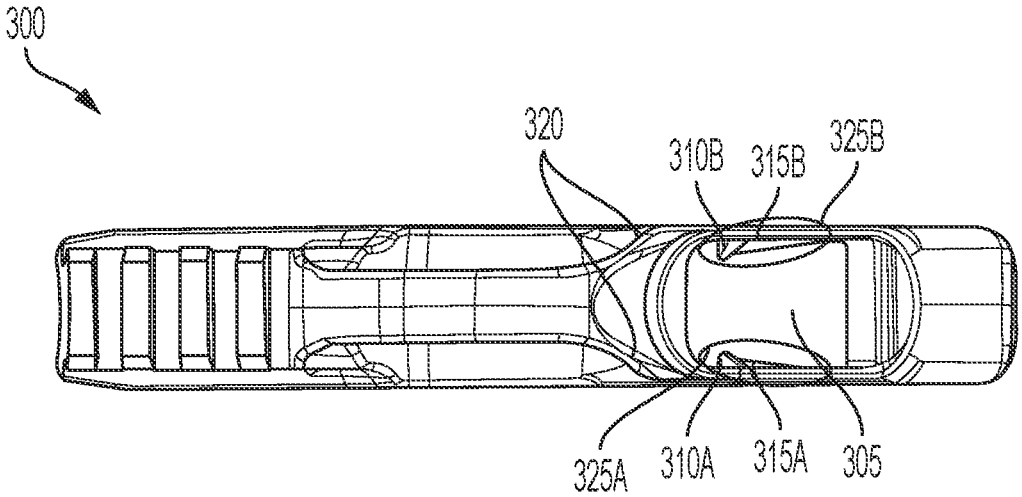
FIG. 3 illustrates a bottom view of an embodiment of a modular firearm adapter.

FIG. 3 illustrates a bottom view of a modular firearm adapter 300. As shown in FIG. 3, modular firearm adapter 300 includes magazine ejector button apertures 320 and magazine receiving port 305. Magazine ejector button apertures 320 may be located between a trigger guard and magazine receiving port 305. Magazine receiving port 305 is located near the proximal end of modular firearm adapter 300. As shown in FIG. 3, adapter elements may include two ramps 325A and 325B which may be disposed within receiving port 305 and may be located on the right and left sides of receiving port 305 and are substantially mirror images of each other. However, ramps 325A and 325B are merely exemplary of an adapter that may be used in modular firearm adapter 300. An adapter element need not include a ramp, or any other element specifically described herein. Rather, any adapter may be used that centers a magazine within magazine receiving port 305 may be used. The adapter may tend to center the magazine from left to right and/or front to rear. The adapter may also function to ensure that a properly installed magazine that is not intended for use with a slide on the firearm is positioned correctly to allow normal operation of a firearm by releasing an ammunition cartridge from the magazine and installing it in firing position within a chamber/bore of the firearm.

Ramp 325A as an adapter element may be comprised of adapter sub-elements that include spine 310A a wedge (not seen because of perspective) and tail 315A. Tail 315A may be connected to both spine 310A and a wedge. Spine 310A is the distal end of the ramp 325A. Spine 310A extends off the sides of receiving port 305 and runs substantially parallel with the length of receiving port 305. Substantially parallel in this context means plus or minus 25 degrees. The portion of spine 310A with the greatest extension off the side of receiving port 305 is located near the top of receiving port 305 and the portion of spine 310A that extends the least off the side of receiving port 305 is toward the bottom end of receiving port 305. As a result, spine 310A slopes downwards from top to bottom of receiving port 305.

Figure 4:
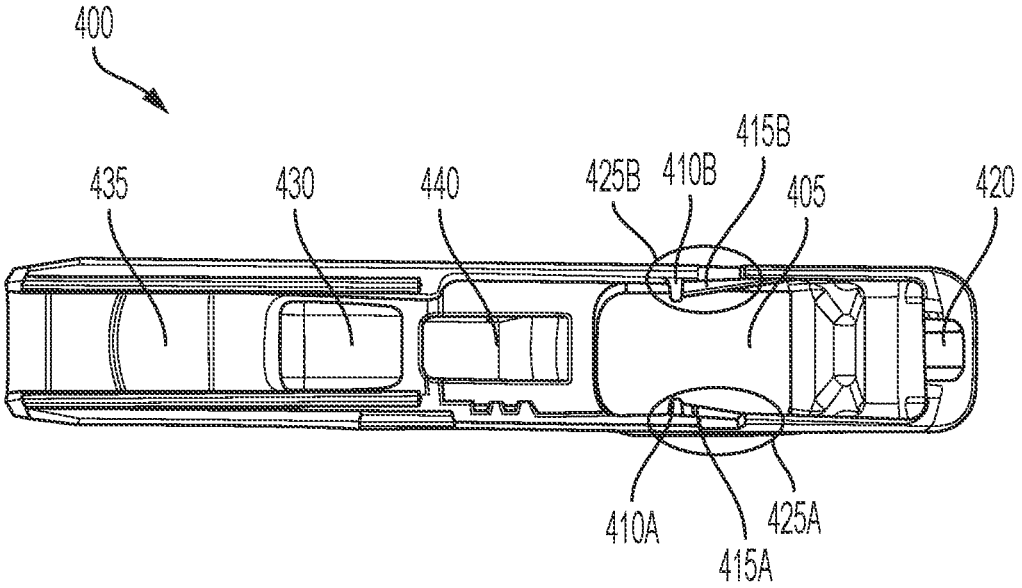
FIG. 4 illustrates a top view of an embodiment of a modular firearm adapter.
Figure 7:
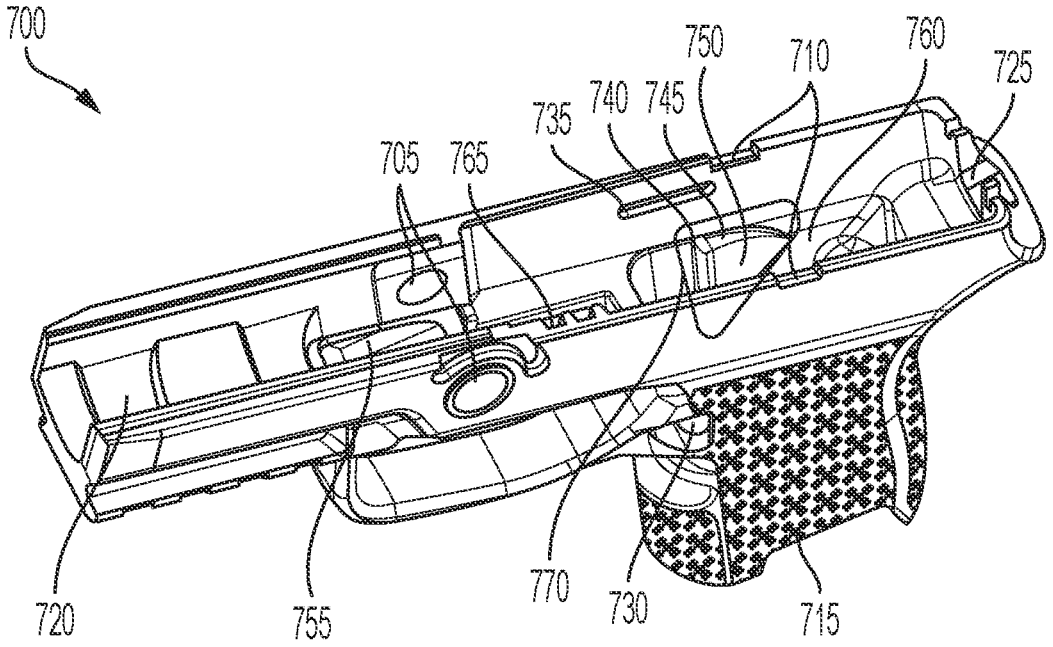
FIG. 7 illustrates a top perspective view of an embodiment of a modular firearm adapter.
Figure 8:
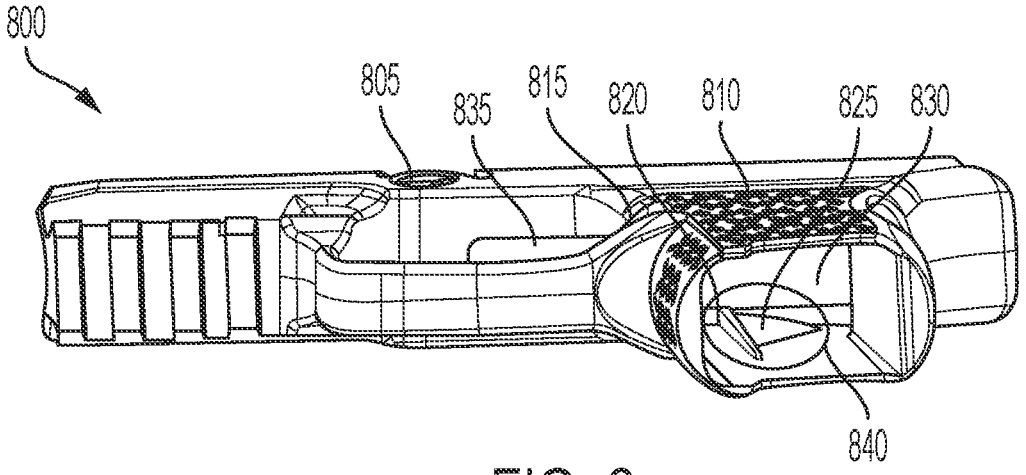
FIG. 8 illustrates a bottom perspective view of an embodiment of a modular firearm adapter.

The wedge portion of the ramp 325A, not seen in this figure because of the perspective but an example is shown in FIGS. 4, 7, and 8, is connected to spine 310A and extends off of the side wall of receiving port 305. The portion of the wedge with the greatest extension off of the side wall of the receiving port 305 is where the wedge connects to spine 310A and the least extension is located towards the proximal end near the top of receiving port 305. As a result, the wedge portion of the ramp 325A extend at the highest point where it connects to spine 310A and the extension lessens as the wedge nears the proximal portion of receiving port 305. The wedge may run substantially perpendicular to spine 310A. Substantially perpendicular in this context means plus or minus 25 degrees. Also, a wedge may curve from the point where it attaches to spine 310A and curves downward and proximal until the lowest point of extension of the wedge off the sidewall wall of the receiving port 305. Tail 315A connects to both spine 310A and a wedge of ramp 325A. The extension of spine 310A gradually decreases towards the bottom part of receiving port 305. Tail 315A may connect to the proximal side of spine 310A but does not extend from receiving port 305 to the height of spine 310A. Thus, tail 315A may connect to the side of spine 310A at less than the full extension but more than halfway up the extension of spine 310A. Tail 315A alternatively, extends off of receiving port at the same height as the wedge and decreases and maintains the same height of the wedge. Even though tail 315A may not extend out as much as spine 310A and tail 315A the extension lessens at the same slope and the extension of tail 315A ends before the extension of spine 310A ends at the downward portion of spine 310A.

Adapter element may also include ramp 325B that may further include adapter sub-elements that include spine 310B a wedge (not seen because of perspective but shown in FIGS. 4 and 8) and tail 315B. Tail 315B may be connected to both spine 310B and a wedge. Spine 310B is the distal end of the ramp 325B. Spine 310B extends off the sides of receiving port 305 in a sloping manner. The spine 310B runs substantially parallel with the length of receiving port 305. Substantially parallel in this context means plus or minus 25 degrees. The portion of spine 310B with the greatest extension off the side of receiving port 305 is located near the top of receiving port 305 and the portion of spine 310B that extends the least off the side of receiving port 305 is toward the bottom end of receiving port 305. As a result, spine 310B slopes downwards from top to bottom of receiving port 305.

The wedge, an adapter sub-element portion of the ramp 325B, not seen in this figure because of perspective, is connected to spine 310B and extends off of the side wall of receiving port 305 towards a center line of firearm adapter 300. The portion of the wedge with the greatest extension off of the side wall of the receiving port 305 is where the wedge connects to spine 310B and the least extension is located towards the proximal end of receiving port 305 near the top of receiving port 305. As a result, the wedge portion of the ramp extends at the highest point at spine 310B attachment and lessens as the wedge nears the proximal portion of receiving port 305. The wedge may run substantially perpendicular to spine 310B. Substantially perpendicular in this context means plus or minus 25 degrees. Also, a wedge may curve from the point where the wedge attaches to spine 310B and curves downward and proximal until the lowest point of extension of the wedge off the sidewall wall of the receiving port 305. Tail 315B connects to spine 310B and wedge and the extension of spine 310B gradually decreases towards the bottom part of receiving port 305. Tail 315B connects to the proximal side of spine 310B but does not extend from receiving port 305 to a height of spine 310B. Thus, tail 315B connects to the side of spine 310B at less than the full extension but more than halfway up the extension of spine 310B. Tail 315B alternatively, extends off of receiving port at the same height as the wedge and decreases and maintains the same height of the wedge. Even though tail 315B does not extend out as much as spine 310B tail 315B decreases at the same angle and the extension of tail 315B ends before the extension of the spine 310B ends at the downward portion of spine 310B.

FIG. 4 illustrates a top view of a modular firearm adapter 400. Modular firearm adapter 400 includes adapter elements and adapter sub-elements which tend to position a magazine that is not intended to work with a particular firearm slide in a position to function properly within modular firearm adapter 400. Modular firearm adapter 400 may also include a magazine receiving port 405 wherein one or more ramps 425A and 425B may be disposed. The ramp 425A, an adapter element, may include adapter sub-elements such as spine 410A, wedge 415A and a tail, not seen because of the perspective but an example may be seen in FIGS. 3, 7, and 8. Spine 410A extends substantially parallel with the length of the receiving port 405. Substantially parallel in this context means plus or minus 25 degrees. Wedge 415A connects to spine 410A and extends substantially perpendicularly to the proximal end of receiving port 405 and may curve in a downward direction. Substantially perpendicular in this context means plus or minus 25 degrees. The tail connects to wedge 415A and spine 410A and follows the slope of both spine 410A and wedge 415A.

The ramp 425B may include spine 410B, wedge 415B and a tail, not seen because of perspective. Spine 410B extends substantially parallel to a length (top to bottom) of the receiving port 405. Substantially parallel in this context means plus or minus 25 degrees. Wedge 415B extends substantially perpendicularly to spine 410B towards the proximal end of receiving port 405 and may be also curve in a downward direction. Substantially perpendicular in this context means plus or minus 25 degrees. The tail connects to wedge 415B and spine 410B and follows the slope of both spine 410B and wedge 415B. Firearm adapter 400 may further include trigger port 440, where a trigger may be placed and may be located between receiving port 405 and trigger group seat 430. Trigger group seat 430 is located proximally to rod guide 435 and trigger port 440.

Figure 5:
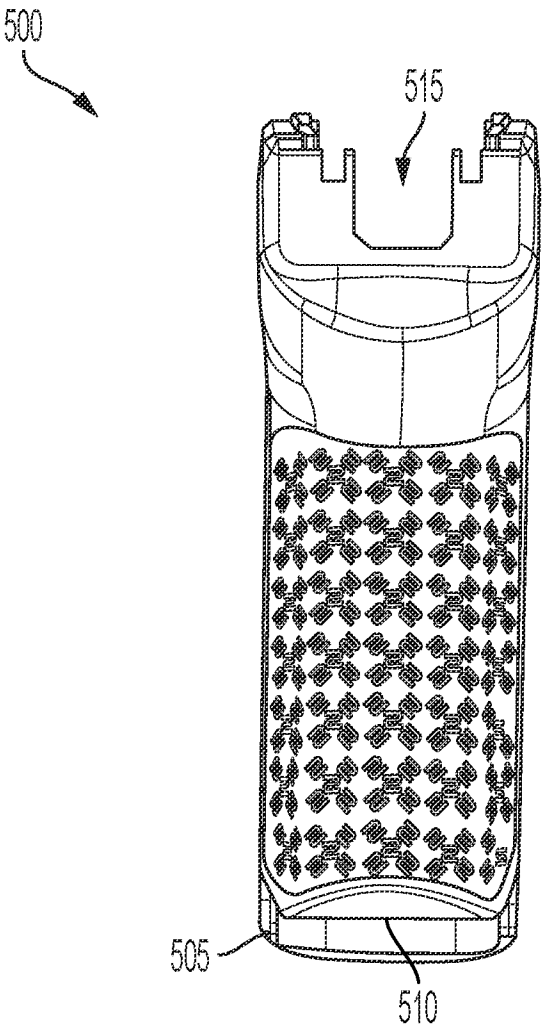
FIG. 5 illustrates a proximal view of an embodiment of a modular firearm adapter.

FIG. 5 illustrates a proximal view of a modular firearm adapter 500. Modular firearm adapter 500 includes adapter and adapter elements such as magazine seat notch 505 located at the bottom of magazine receiving port 510 where a magazine may be placed. The base of ammunition magazines is often larger than the magazine that allows a user to assist in the ejection of the magazine by pulling on the larger base portion when some malfunction in the ejection process occurs or to allow for an extended grip length for the firearm. Above receiving port 510 is rear slide cover notch 515 that may receive a rear slide plate or be located near a rear slide plate.

Figure 6:
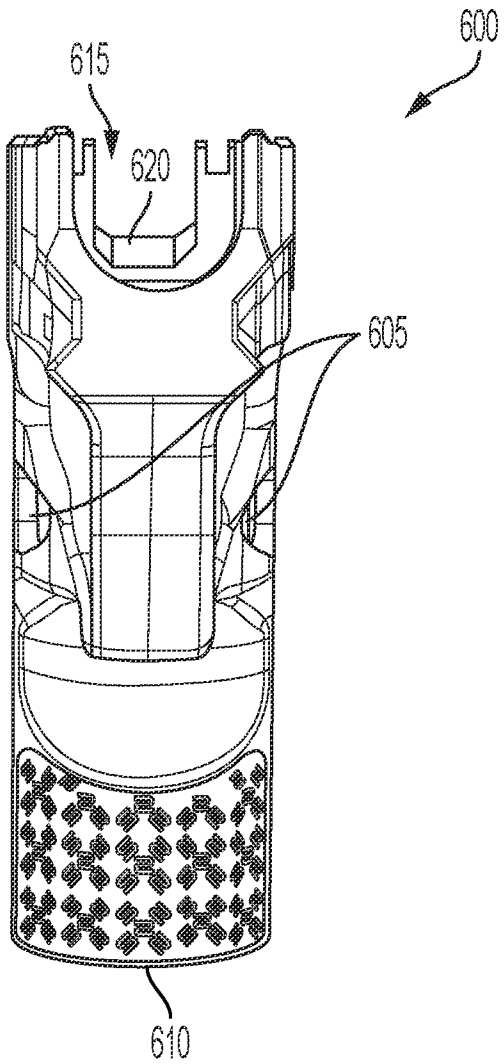
FIG. 6 illustrates a distal view of an embodiment of a modular firearm adapter.

FIG. 6 illustrates a distal view of a modular firearm adapter 600. Modular firearm adapter 600 may include an adapter and adapter elements such as magazine ejector button apertures 605 located proximally to the trigger guard but distally to the receiving port 610. At the proximal end is located rear slide cover notch 615 that may receive a rear slide plate or be located near a rear slide plate 615. At the distal end of modular firearm adapter 600 is rod guide 620 that may house the guide rod and or recoil spring for the firearm.

FIG. 7 illustrates a top perspective view of a modular firearm adapter 700. Modular firearm adapter 700 includes disassembly pin apertures 705 on both the right and left side of modular firearm adapter 700. Also, on both the right and left side of modular firearm adapter 700 slide catch notches 710 may be installed. On the distal end near the bottom of modular firearm adapter 700 is magazine seat notch 715. Magazine seat notch 715 receives the base a of an ammunition magazine which is generally larger than remaining portions of a magazine. Seat notch 715 may allow a user easier access to the magazine to aid in the magazine removal or allow a magazine to provide an extended grip for modular firearm adapter 700. On the distal end of modular firearm adapter 700 is rod guide 720 that is generally U-shaped (semi-circular) and to accommodate a guide rod and or recoil spring that is attached to a slide. Proximally opposite rod guide 720 is rear cover plate notch 725 and is located at the proximal end of modular firearm adapter 700. Cover plate notch 725 receives the slide cover plate of a firearm or may be near rear slide cover plate of the firearm. Located distally to cover plate notch 725 and proximally to pin aperture is magazine ejector button aperture 730.

Magazine ejector button aperture 730 may be provided with a button that releases a magazine from modular firearm adapter 700 and may extend through an aperture on both the left and right side of modular firearm adapter 700. Depending on the type and the style of firearm a serial number is displayed on the firearm. In cases where the firearm is displayed on a trigger group unit, view port 735 is placed on the right side of modular firearm adapter 700 in this embodiment. However, a serial number may be placed in various locations as required by the United States Department of Alcohol, Tobacco, and Firearms. Adapter 770 is implemented as a ramp, in this embodiment, and is located on the inside of magazine receiving port 760. Adapter 770 is positioned to allow a magazine that is not intended (e.g., smaller) to function with a particular slide to be positioned to operate correctly with the particular slide. In this case, adapter 770 further includes adapter sub-element such as a spine 740, a wedge 745 and a tail 750. Spine 740 runs substantially parallel with the length of receiving port 760. Substantially parallel in this context means plus or minus 25 degrees. Wedge 745, on the other hand, extends from spine 740 proximally in a substantially perpendicular direction and may contain a downward curve. Substantially perpendicular in this context means plus or minus 25 degrees. Tail 750 is connected to both spine 740 and wedge 745 and the extension of tail 750 off of receiving port 760 decreases downwardly and proximally.

Proximally to rod guide 720 is trigger group seat 755 this depression may seat a bracket or another portion of a trigger group or a rail that may aid in the attachment of a firearm slide. Proximally to trigger group seat 755 and distally to magazine receiving port 760 is trigger port 765. Trigger port 765 allows a trigger to maintain attachment to the trigger group while allowing access to the user to pull when firing the firearm. Proximally to trigger port 765 is magazine receiving port 760. The angle of magazine receiving port and a position of the ramp extending off of the side wall of the ramp allows for the reception of a particular ammunition magazine that is, for example, smaller dimensionally than a magazine that is intended to be used with a slide connectable to modular firearm adapter 700.

FIG. 8 illustrates a bottom perspective view of a modular firearm adapter 800. Modular firearm adapter 800 includes disassembly pin aperture 805. Proximally to pin aperture 805 is trigger port 835 that receives a trigger portion of the trigger assembly. Proximally to trigger port 835 is ejector pin aperture 815 that may receive an ejector pin that may actuate the release of a cartridge magazine from magazine receiving port 830. Magazine receiving port 830 may accommodate a particular ammunition magazine with the corresponding size and angle and caliber of ammunition.

Disposed within magazine receiving port 830 may be an adapter, a ramp in this example, that may include adapter sub-elements such as spine 820, tail 825, and a wedge (not shown because of perspective but an example shown in FIGS. 4 and 7). A ramp may be placed on one or both sides of spine 820 that runs substantially parallel to the length of magazine receiving port 830 and extends off of the side wall of magazine receiving port 830. Substantially parallel in this context means plus or minus 25 degrees. The greatest extension of spine 820 is located at the top end of spine 820 and the smallest extension of spine 820 is located at the bottom end of the spine. A top portion of spine 820 is connected to a wedge that extends off substantially perpendicularly to spine 820. Substantially perpendicular in this context means plus or minus 25 degrees. The wedge may be curved in a substantially perpendicular direction and the greatest extension of the wedge is the distal end of the wedge where it connects to spine 820. The smallest extension of the wedge is located at the proximal end of the wedge. Tail 825 is connected to spine 820 and the wedge. Tail 825 follows the slope of both the wedge and spine 820. Adapter 840 may be implemented in multiple shapes and sizes to accommodate a corresponding ammunition magazine. Because ammunition magazines generally have a base that is larger than other parts of the magazine, magazine seat notch 810 may be placed at the bottom end of receiving port 830. Magazine seat notch 810 may be located on both the right and left slide or may be a continuous notch on apportion of the bottom end of receiving port 830

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A modular firearm frame device, comprising:

a receiver rail which mechanically interacts with a firearm slide mechanically sized to operate on a first firearm model;

a magazine port which mechanically accepts a magazine from a second firearm model, different from the first firearm model;

an adapter disposed within the magazine port which aligns the magazine within the magazine port such that the magazine holds an ammunition cartridge in a position within the modular firearm frame device where operation of the slide on the modular firearm frame device causes the ammunition cartridge to be loaded into a chamber of a firearm associated with the modular firearm frame device; and a ramp that slopes downward from a top portion of the magazine port such that the largest extension of the ramp from the magazine port is at the top of the magazine port and the smallest extension of the ramp from the magazine port is at a bottom portion of the magazine port.

2. The modular firearm frame device of claim 1, wherein the ramp on a side of the magazine port includes a spine disposed on the distal end of the ramp.

3. The modular firearm frame device of claim 2, wherein the spine is positioned parallel to the length of the magazine port.

4. The modular firearm frame device of claim 3, the ramp further comprising:

a wedge that extends substantially perpendicularly to the spine.

5. The modular firearm frame device of claim 4, the ramp further comprising:

a tail that connects to both the spine and the wedge.

6. The modular firearm frame device of claim 5, wherein the tail follows the slope of the wedge and the slope of the spine.

7. The modular firearm frame device of claim 1, wherein the adapter includes a second ramp.

8. The modular firearm frame device of claim 7 wherein the second ramp is located opposite the first ramp within the magazine port.

9. The modular firearm frame device of claim 7, wherein the second ramp is disposed within the magazine port as a mirror image of the first ramp.

10. A modular firearm frame device comprising:

a receiver rail mechanically sized to accept a slide from a first handgun; and a magazine port sized to operably receive a magazine that is inoperable in the first handgun;

an adapter disposed within the magazine port which aligns the magazine within the magazine port such that the magazine holds an ammunition cartridge in a position within the modular firearm frame device where operation of the slide on the modular firearm frame device causes the ammunition cartridge to be loaded into a chamber of a firearm associated with the modular firearm frame device; and a ramp that slopes downward from a top of the magazine port such that the largest extension of the ramp from the magazine port is at the top portion of the magazine port and the smallest extension of the ramp from the magazine port is at a bottom portion of the magazine port.

11. The modular firearm frame device of claim 10, wherein the ramp on a side of the magazine port includes a spine disposed on the distal end of the ramp.

12. The modular firearm frame device of claim 11, wherein the spine is positioned parallel to the length of the magazine port.

13. The modular firearm frame device of claim 12, the ramp further comprising:

a wedge that extends substantially perpendicularly to the spine.

14. The modular firearm frame device of claim 13, the ramp further comprising:

a tail that connects to both the spine and the wedge.

15. The modular firearm frame device of claim 14, wherein the tail follows the slope of the wedge and the slope of the spine.

16. The modular firearm frame device of claim 10, wherein the adapter includes a second ramp.

17. The modular firearm frame device of claim 16 wherein the second ramp is located opposite the first ramp within the magazine port.

18. The modular firearm frame device of claim 17, wherein the second ramp is disposed within the magazine port as a mirror image of the first ramp.

* * * * *